US009637892B2

(12) United States Patent
Lee et al.

(10) Patent No.: US 9,637,892 B2
(45) Date of Patent: May 2, 2017

(54) VERTICAL FAUCET STRUCTURE

(71) Applicant: Ching Shenger Co., Ltd., Xianxi Township, Changhua County (TW)

(72) Inventors: Chin-Tsai Lee, Xianxi Township (TW); Ming-Che Lee, Xianxi Township (TW)

(73) Assignee: Ching Shenger Co., Ltd., Xianxi Township (TW)

( * ) Notice: Subject to any disclaimer, the term of this patent is extended or adjusted under 35 U.S.C. 154(b) by 0 days.

(21) Appl. No.: 14/825,432

(22) Filed: Aug. 13, 2015

(65) Prior Publication Data

US 2017/0044745 A1 Feb. 16, 2017

(51) Int. Cl.
*E03C 1/04* (2006.01)

(52) U.S. Cl.
CPC ..... *E03C 1/04* (2013.01); *E03C 1/0403* (2013.01)

(58) Field of Classification Search
CPC ..... E03C 1/04; E03C 1/0403
USPC ..... 137/801; 4/675, 676, 677, 678, 695
See application file for complete search history.

(56) References Cited

U.S. PATENT DOCUMENTS 8,185,984 B2 * 5/2012 Meehan ..... E03C 1/0401 137/801
2010/0282349 A1 * 11/2010 Esche ..... E03C 1/04 137/801

* cited by examiner

*Primary Examiner* — Michael R Reid
*Assistant Examiner* — Paul J Gray
(74) *Attorney, Agent, or Firm* — Alan D. Kamrath; Kamrath IP Lawfirm, P.A.

(57) ABSTRACT

A pressure gauge structure contains: a body, a positioning sleeve, outlet unit, a fixing member, and a guiding seat. The body includes a chamber and an abutting rib, and the abutting rib has a circular orifice and a noncircular locating rim. The positioning sleeve includes a locking portion retaining with the noncircular locating rim of the body, and the positioning sleeve also includes a connecting hole defined in the top thereof and aligning with the circular orifice. The outlet unit includes a coupling section inserted into the connecting hole from the circular orifice. The fixing member includes an aperture and is fitted and engaged in the positioning sleeve and connected with the coupling section to guide rotation of the outlet unit and to limit removal of the coupling section from the body. The guiding seat is fixed in the chamber and retains with the positioning sleeve.

9 Claims, 9 Drawing Sheets

VERTICAL FAUCET STRUCTURE

BACKGROUND OF THE INVENTION

Field of the Invention

The present invention relates to a faucet structure and more particularly, to a vertical faucet structure containing an outlet unit fixed in a body to avoid damage of the vertical faucet structure and to allow the vertical faucet structure to be assembled easily and quickly.

Description of the Prior Art

A conventional vertical faucet structure contains an outlet pipe configured in a fixed type or in a movable type. For example, when the outlet pipe is fixed, it is formed with a body as one piece. Hence, after assembling the conventional vertical faucet structure, a positioning direction of the outlet pipe is fixed to simplify structure. However, this outlet pipe interferes with the body in some states. On the contrary, when the outlet pipe is movable, it is rotated within an angle range. Such an outlet pipe is complicated, even through it is adjustably rotated within the angle range to obtain using convenience.

The conventional vertical faucet structure contains a body and an outlet pipe. The body is a vertical pipe and includes a connecting groove defined on an upper end thereof and a threaded orifice formed on a peripheral side thereof and communicating with the connecting groove. The threaded orifice is screwed with a screwing bolt, and the outlet pipe has a coupling section arranged on a lower end thereof. The outlet pipe also has a limiting recess defined on a peripheral side of the coupling section, and the coupling section is inserted into the connecting groove of the body. Thus, the limiting recess faces the screwing bolt, and the screwing bolt is inserted and fixed in the limiting recess to guide rotation of the outlet pipe and to limit removal of the coupling section of the outlet pipe from the connecting groove of the body.

Nevertheless, the body includes the threaded orifice formed on the peripheral side thereof to screw with the screwing bolt and to expose the screwing bolt, thus damaging an appearance of the vertical faucet structure and accumulating filth in the vertical faucet structure. In addition, the screwing bolt is inserted into the limiting recess of the coupling section of the outlet pipe to fix and limit the outlet pipe, so the outlet pipe shakes easily since the coupling section of the outlet pipe does not contact with the connecting groove of the body, thereby causing water leakage.

The present invention has arisen to mitigate and/or obviate the afore-described disadvantages.

SUMMARY OF THE INVENTION

The primary objective of the present invention is to provide a vertical faucet structure in which an outlet unit is rotatably connected on a body smoothly to avoid damage of the vertical faucet structure and filth accumulation in the vertical faucet structure. Preferably, the outlet unit does not shake to cause water leakage, thus obtaining assembly quality and using convenience.

Another objective of the present invention is to provide a vertical faucet structure in which a guiding seat is fixed in a chamber of the body to retain with a positioning sleeve, such that the vertical faucet structure is assembled easily and quickly to enhance connecting efficiency and to reduce assembly cost and time.

Accordingly, a vertical faucet structure provided by the present invention contains: a body, a positioning sleeve, an outlet unit, a fixing member, and a guiding seat.

The body is a vertical pipe and includes a chamber defined therein, and the body also includes an abutting rib formed on an upper end thereof. The abutting rib has a circular orifice passing through a central portion thereof and communicating with the chamber, and the abutting rib also has a noncircular locating rim extending downwardly from a bottom thereof and a peripheral side of the circular orifice.

The positioning sleeve includes a locking portion arranged on a top thereof and mounted in an upper end of the chamber of the body. The locking portion of the positioning sleeve retains with the noncircular locating rim of the body, and the positioning sleeve also includes a connecting hole defined in the top thereof and aligning with the circular orifice.

The outlet unit includes a coupling section inserted into the connecting hole of the positioning sleeve from the circular orifice of the abutting rib of the body.

The fixing member includes an aperture defined therein and passing therethrough, and the fixing member is fitted and engaged in the positioning sleeve and connected with the coupling section of the outlet unit to guide rotation of the outlet unit and to limit removal of the coupling section of the outlet unit from the body.

The guiding seat is fixed in the chamber of the body and is located below and retains with the positioning sleeve.

DETAILED DESCRIPTION OF THE PREFERRED EMBODIMENTS

Figure 1:
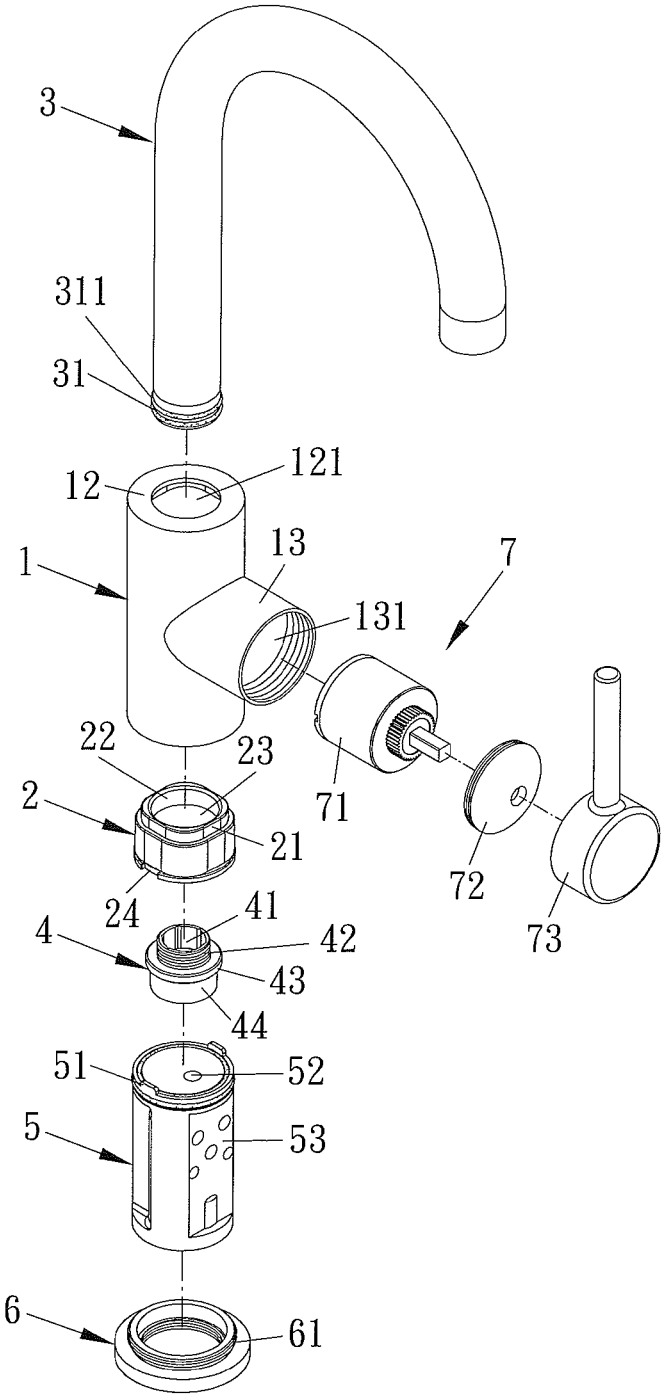
FIG. 1 is a perspective view showing the exploded components of a vertical faucet structure in accordance with a first embodiment of the present invention.
Figure 2:
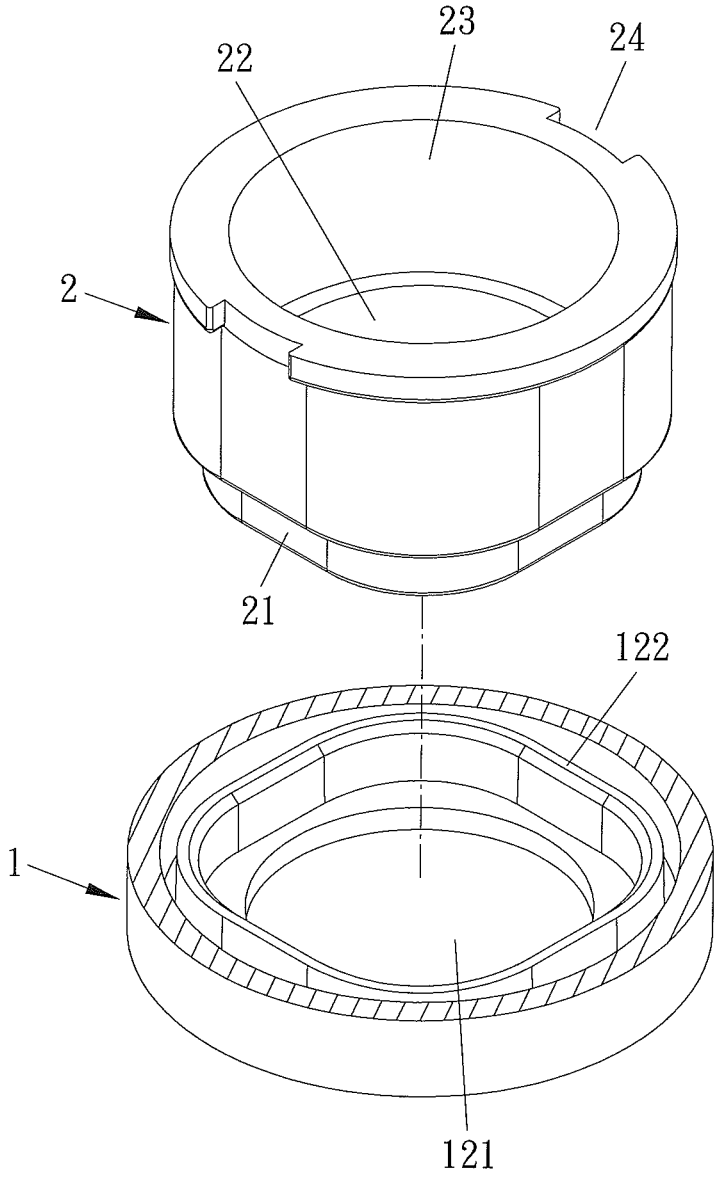
FIG. 2 is a perspective view showing the exploded components of a part of a body and a positioning sleeve of the vertical faucet structure in accordance with the first embodiment of the present invention.
Figure 3:
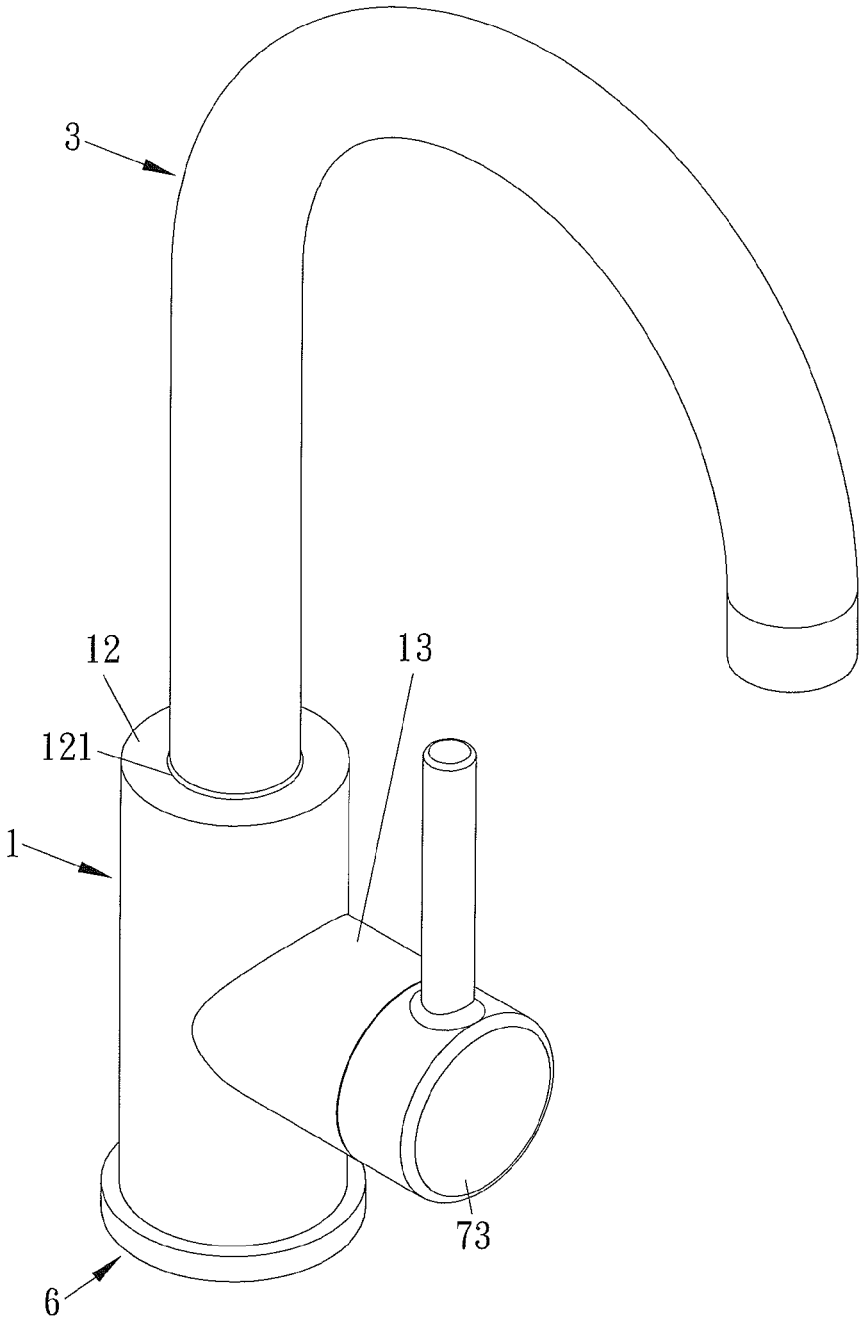
FIG. 3 is a perspective view showing the assembly of the vertical faucet structure in accordance with the first embodiment of the present invention.
Figure 4:
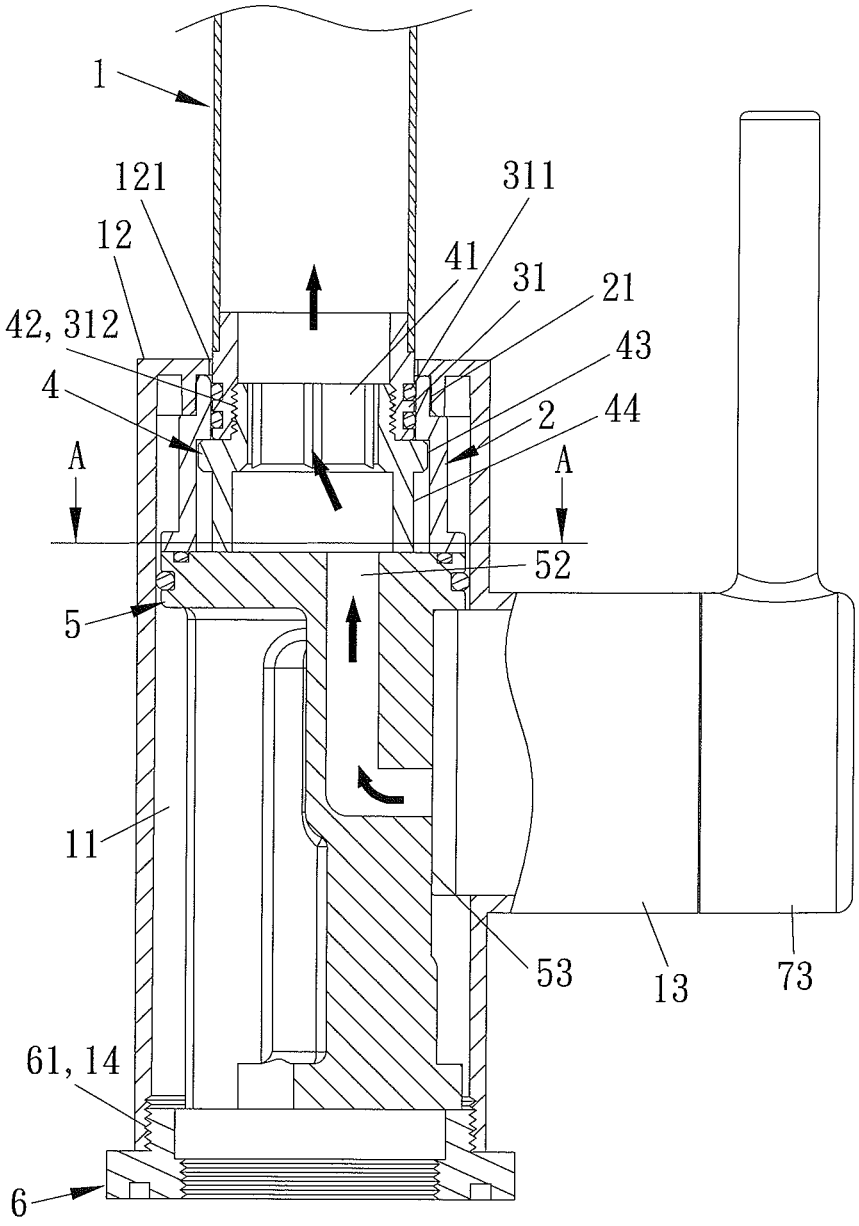
FIG. 4 is a cross sectional view showing the operation of the vertical faucet structure in accordance with the first embodiment of the present invention.
Figure 5:
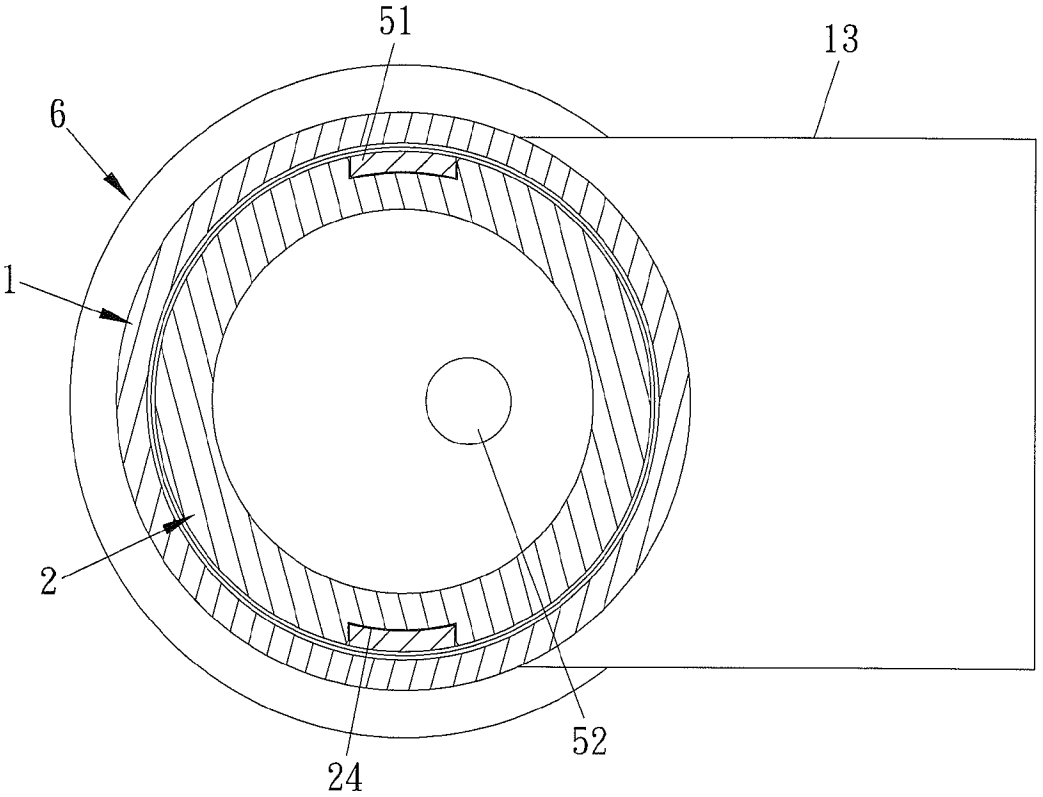
FIG. 5 is a cross sectional view taken along the line A-A of FIG. 4.

The present invention will be clearer from the following description when viewed together with the accompanying drawings, which show, for purpose of illustration only, the preferred embodiments in accordance with the present invention.

With reference to FIGS. 1-5, a vertical faucet structure according to a first embodiment of the present invention comprises: a body 1, a positioning sleeve 2, an outlet unit 3, a fixing member 4, a guiding seat 5, a connecting cover 6, and a control unit 7.

The body 1 is a vertical pipe and includes a chamber 11 defined therein and communicating with a lower end thereof. The body 1 also includes an abutting rib 12 formed on an upper end thereof. The abutting rib 12 has a circular orifice 121 passing through a central portion thereof and communicating with the chamber 11, and the abutting rib 12 also has a noncircular locating rim 122 extending downwardly from a bottom thereof and a peripheral side of the circular orifice 121. The body 1 further includes a valve holder 13 extending outwardly from a peripheral side thereof, and the valve holder 13 has a flowing room 131 defined therein and communicating with the chamber 11. The body 1 further includes first inner threads 14 formed on a bottom of an inner wall thereof.

The positioning sleeve 2 includes a locking portion 21 arranged on a top thereof, a connecting hole 22 defined in the top thereof, and a limiting hole 23 defined therein below the connecting hole 22. A diameter of the connecting hole 22 is greater than that of the limiting hole 23. The positioning sleeve 2 further includes two retaining recesses 24 arranged on a bottom thereof and is mounted in an upper end of the chamber 11 of the body 1. The locking portion 21 of the positioning sleeve 2 is retained within the noncircular locating rim 122 of the body 1.

The outlet unit 3 is an outlet pipe and includes a coupling section 31 formed on an lower end thereof. The coupling section 31 has a closing ring 311 fitted on an outer wall thereof and has second inner threads 312 formed on an inner wall thereof. The coupling section 31 is inserted into the connecting hole 22 of the positioning sleeve 2 from the circular orifice 121 of the abutting rib 12 of the body 1, such that the closing ring 311 of the coupling section 31 contacts with an inner wall of the connecting hole 22 of the positioning sleeve 2 to stop water.

The fixing member 4 includes an aperture 41 defined therein and passing therethrough, a screwing tube 42 arranged on a top thereof, and a limitation portion 43 formed below the screwing tube 42. A diameter of the limitation portion 43 is greater than that of the screwing tube 42. The fixing member 4 further includes a circular affix section 44 formed on a bottom thereof. The screwing tube 42 is screwed with the second inner threads 312 of the coupling section 31 of the outlet unit 3. The limitation portion 43 is fitted and engaged in the limiting hole 23 of the positioning sleeve 2 to guide rotation of the outlet unit 3 and to limit removal of the coupling section 31 of the outlet unit 3 from the body 1.

The guiding seat 5 includes two protrusions 51 arranged on an upper end thereof and corresponding to the two retaining recesses 24 of the positioning sleeve 2, an outlet 52 defined on a top surface thereof, and plural joining faces 53 arranged a peripheral side of the guiding seat 5. Each of the plural joining faces 53 has a plurality of flowing pores formed thereon. The guiding seat 5 is fixed in the chamber 11 of the body 1, so that the two protrusions 51 retain with the two retaining recesses 24 of the positioning sleeve 2. The plural joining faces 53 automatically align with the flowing room 131 of the valve holder 13, the circular affix section 44 of the fixing member 4 abuts against the top surface of the guiding seat 5, and the outlet 52 of the guiding seat 5 is in communication with the outlet unit 3 via the aperture 41 of the fixing member 4.

The connecting cover 6 includes outer threads 61 to screw with the first inner threads 141 formed on the bottom of the inner wall of the body 1, thus fixing the guiding seat 5 in the chamber 11 of the body 1.

The control unit 7 includes a controlling valve 71, a screwing cap 72, and a rotating lever 73. The controlling valve 71 is disposed in the flowing room 131 of the valve holder 13 of the body 1 and is fixed by the screwing cap 72. The rotating lever 73 is connected with the control valve 71, so that the rotating lever 73 drives the controlling valve 71 to turn on/off and to control water flow.

Figure 6:
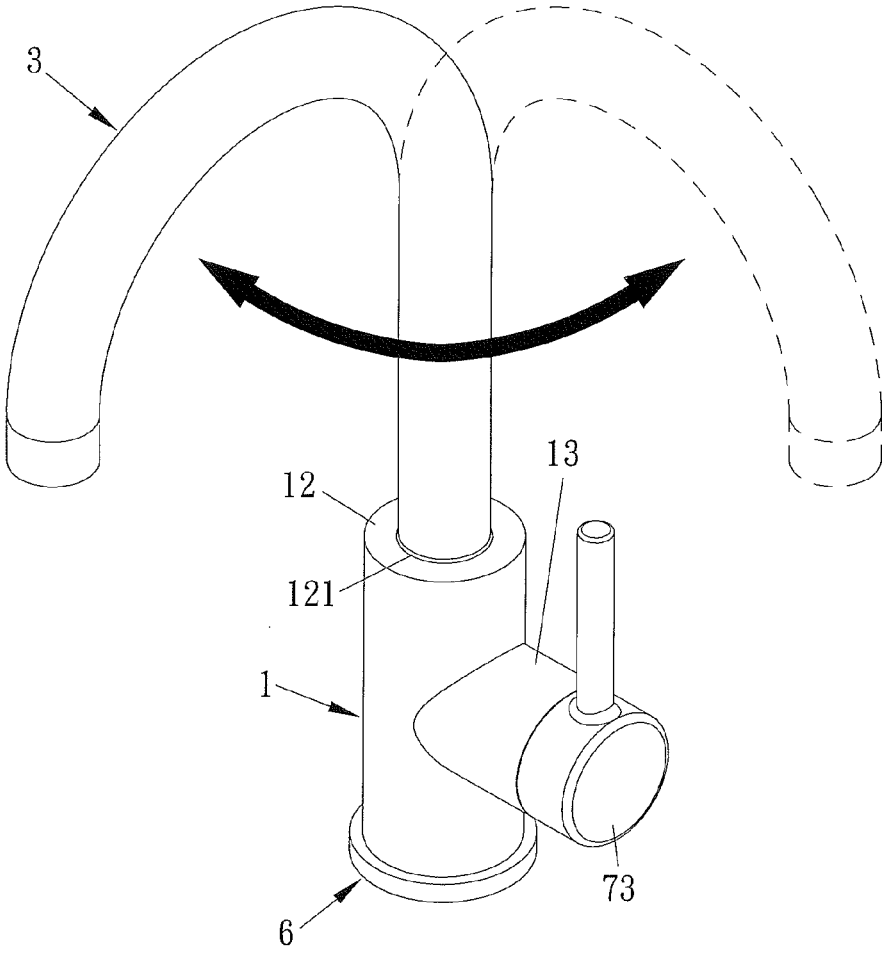
FIG. 6 is a perspective view showing the operation of an outlet unit of the vertical faucet structure in accordance with the first embodiment of the present invention.

When the rotating lever 63 is rotated to start water supply, water flows into the guiding seat 5 and the controlling valve 71. Then, it flows back to the guiding seat 5 and thereafter flows out of the outlet unit 3 from the outlet 52 of the guiding seat 5 via the aperture 41 of the fixing member 4. In use, the outlet unit 3 is inserted into the connecting hole 22 of the positioning sleeve 2 by using the coupling section 31, and the coupling section 31 locks with the fixing member 4 in the positioning sleeve 2. Thus, the coupling section 31 of the outlet unit 3 does not remove from the body 1, so that the outlet unit 3 rotates at a rotatable angle, as illustrated in FIG. 6.

Figure 7:
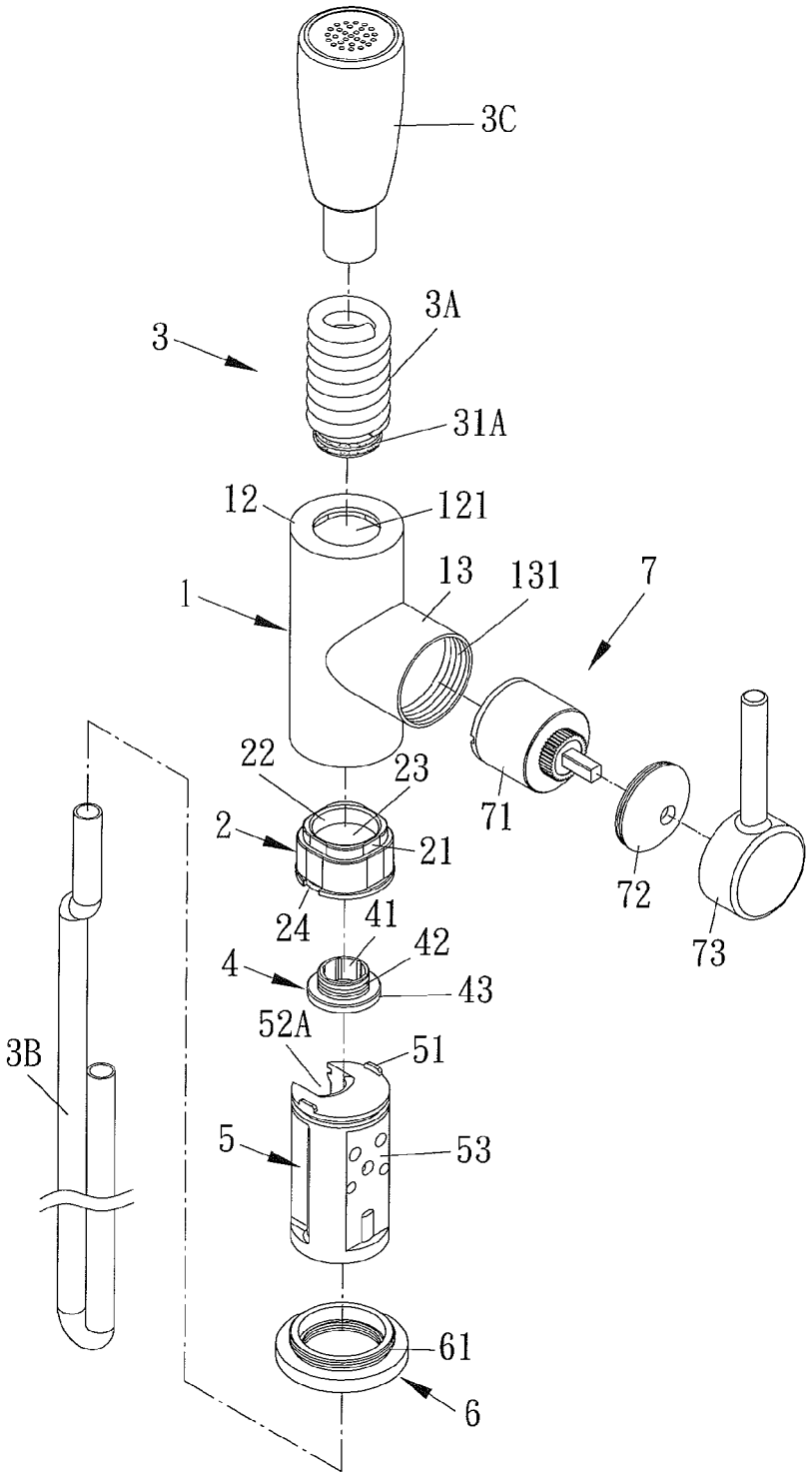
FIG. 7 is a perspective view showing the exploded components of a vertical faucet structure in accordance with a second embodiment of the present invention.
Figure 8:
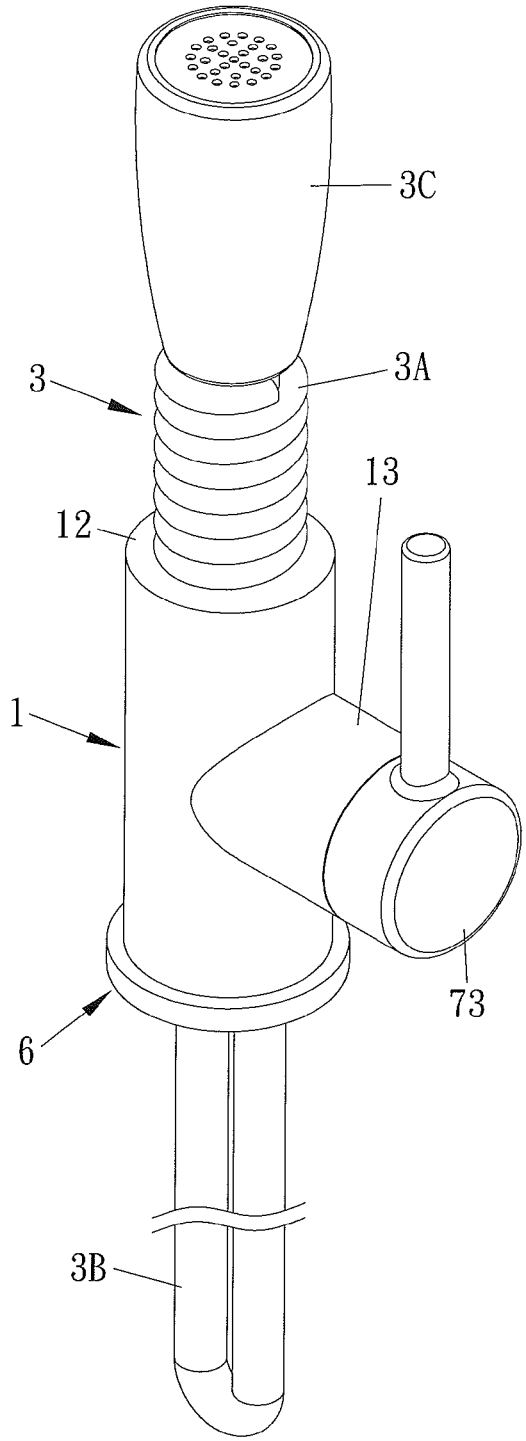
FIG. 8 is a perspective view showing the assembly of the vertical faucet structure in accordance with the second embodiment of the present invention.
Figure 9:
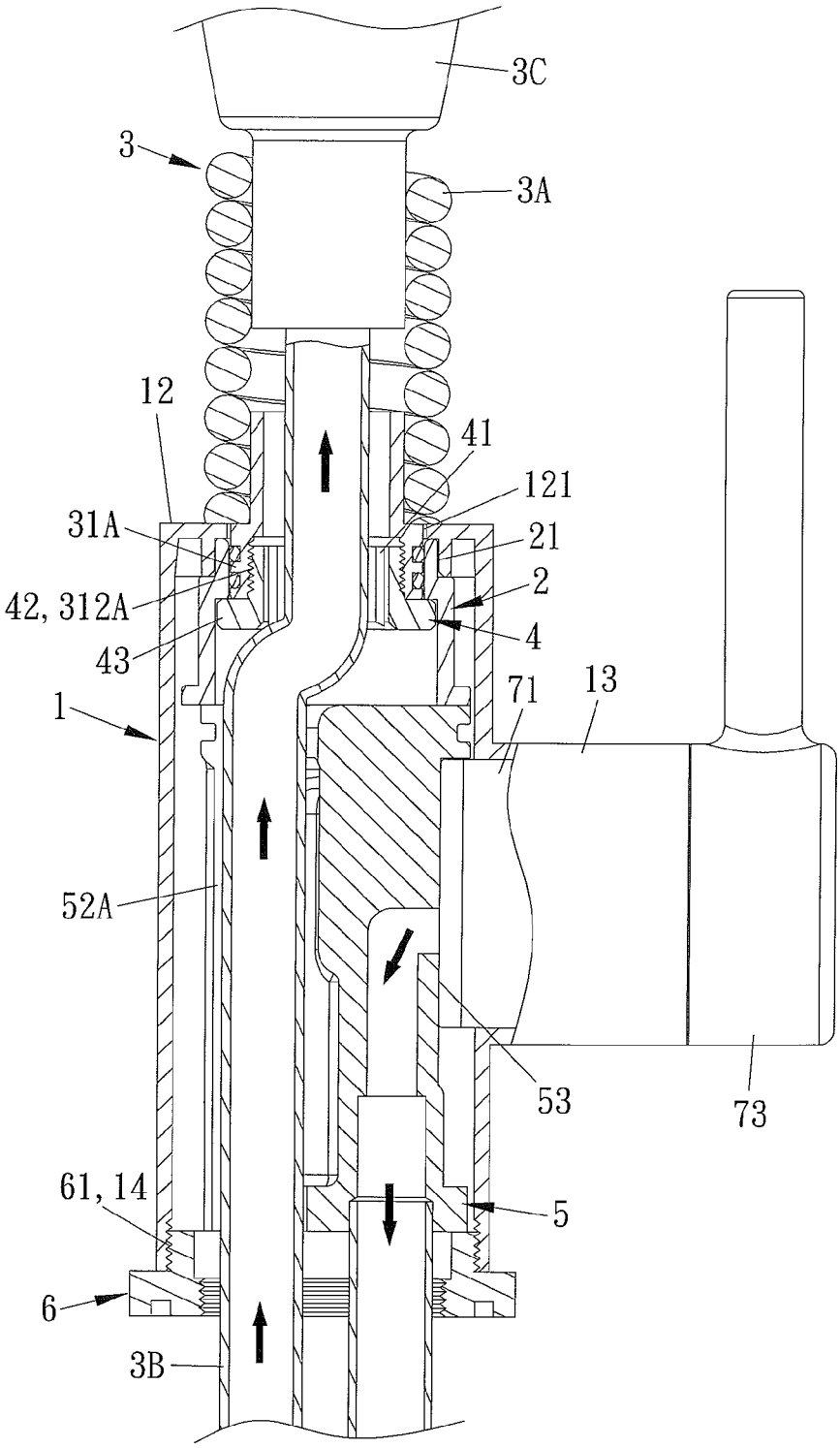
FIG. 9 is a cross sectional view showing the operation of the vertical faucet structure in accordance with the second embodiment of the present invention.

Referring to FIGS. 7-9, a vertical faucet structure according to a second embodiment of the present invention comprises: a body 1, a positioning sleeve 2, an outlet unit 3, a fixing member 4, a guiding seat 5, a connecting cover 6, and a control unit 7.

The body 1 is a vertical pipe and includes a chamber 11 defined therein and communicating with a lower end thereof. The body 1 also includes an abutting rib 12 formed on an upper end thereof. The abutting rib 12 has a circular orifice 121 passing through a central portion thereof and communicating with the chamber 11, and the abutting rib 12 also has a noncircular locating rim 122 extending downwardly from a bottom thereof and a peripheral side of the circular orifice 121. The body 1 further includes a valve holder 13 extending outwardly from a peripheral side thereof, and the valve holder 13 has a flowing room 131 defined therein and communicating with the chamber 11. The body 1 further includes first inner threads 14 formed on a bottom of an inner wall thereof.

The positioning sleeve 2 includes a locking portion 21 arranged on a top thereof, a connecting hole 22 defined in the top thereof, and a limiting hole 23 defined therein below the connecting hole 22. A diameter of the connecting hole 22 is greater than that of the limiting hole 23. The positioning sleeve 2 further includes two retaining recesses 24 arranged on a bottom thereof and is mounted in an upper end of the chamber 11 of the body 1. The locking portion 21 of the positioning sleeve 2 retains with the noncircular locating rim 122 of the body 1.

The outlet unit 3 includes an outflow mount 3A, an outflow hose 3B, and an outflow connector 3C. The outflow mount 3A is hollow and has a coupling section 31A formed on a lower end thereof, and the coupling section 31A has second inner threads 312A formed on an inner wall thereof. The coupling section 31A is inserted into the connecting hole 22 of the positioning sleeve 2 from the circular orifice 121 of the abutting rib 12 of the body 1. Thus, a first end of the outflow hose 3B connects with the outflow connector 3C, and the outflow connector 3C is inserted into the outflow mount 3A.

The fixing member 4 includes an aperture 41 defined therein and passing therethrough, a screwing tube 42 arranged on a top thereof, and a limitation portion 43 formed below the screwing tube 42. A diameter of the limitation portion 43 is greater than that of the screwing tube 42. The fixing member 4 further includes a circular affix section 44 formed on a bottom thereof. The screwing tube 42 is screwed with the second inner threads 312 of the coupling section 31 of the outlet unit 3, and the limitation portion 43 is fitted and engaged in the limiting hole 23 of the positioning sleeve 2 to guide rotation of the outlet unit 3 and to limit removal of the coupling section 31 of the outlet unit 3 from the body 1.

The guiding seat 5 includes two protrusions 51 arranged on an upper end thereof and corresponding to the two retaining recesses 24 of the positioning sleeve 2, a hollow portion 52A defined on a peripheral side thereof, and plural joining faces 53 arranged the peripheral side of the guiding seat 5. Each of the plural joining faces 53 has a plurality of flowing pores formed thereon. The guiding seat 5 is fixed in the chamber 11 of the body 1. Thus, the two protrusions 51 retain with the two retaining recesses 24 of the positioning sleeve 2, and the plural joining faces 53 automatically align with the flowing room 131 of the valve holder 13. A second end of the outflow hose 3B couples with the guiding seat 5, and the outflow hose 3B is inserted into the hollow portion 52A of the guiding seat 5 downwardly.

The connecting cover 6 includes outer threads 61 to screw with the inner threads 14 formed on the bottom of the inner wall of the body 1, thus fixing the guiding seat 5 in the chamber 11 of the body 1.

The control unit 7 includes a controlling valve 71, a screwing cap 72, and a rotating lever 73. The controlling valve 71 is disposed in the flowing room 131 of the valve holder 13 of the body 1 and is fixed by the screwing cap 72. The rotating lever 73 is connected with the control valve 71, so that the rotating lever 73 drives the controlling valve 71 to turn on/off and to control the water flow.

When the rotating lever 73 is rotated to start the water supply, the water flows into the guiding seat 5 and the controlling valve 71. Then, it flows back to the guiding seat 5 and thereafter flows out of the outflow connector 3C from the outflow hose 3B in the guiding seat 5.

Accordingly, the vertical faucet structure of the present invention contains advantages as follows:

1. The outlet unit 3 is rotatably connected on the body 1 smoothly to avoid damage of the vertical faucet structure and filth accumulation in the vertical faucet structure. Preferably, the outlet unit 3 does not shake to cause water leakage, thus obtaining assembly quality and using convenience.

2. The guiding seat 5 of the vertical faucet structure is fixed in the chamber 11 of the body 1 to retain with the positioning sleeve 2. The plural joining faces 53 automatically align with the chamber 11 of the valve holder 13 of the body 1 to assemble the vertical faucet structure easily and quickly, to enhance connecting efficiency, and to reduce assembly cost and time.

While various embodiments in accordance with the present invention have been shown and described, it is clear to those skilled in the art that further embodiments may be made without departing from the scope of the present invention.

What is claimed is:

1. A vertical faucet structure comprising:

a body being a vertical pipe and including a chamber defined therein, with the body also including an abutting rib formed on an upper end thereof, wherein the abutting rib has a circular orifice passing through a central portion thereof and communicating with the chamber, wherein the abutting rib also has a noncircular locating rim extending downwardly from a bottom thereof and a peripheral side of the circular orifice;

a positioning sleeve including a locking portion arranged on a top thereof and mounted in an upper end of the chamber of the body, with the locking portion of the positioning sleeve is retained within the noncircular locating rim of the body, and with the positioning sleeve also including a connecting hole defined in the top thereof and aligning with the circular orifice, wherein the positioning sleeve further includes two retaining recesses arranged on a bottom thereof;

an outlet unit including a coupling section inserted into the connecting hole of the positioning sleeve from the circular orifice of the abutting rib of the body;

a fixing member including an aperture defined therein and passing therethrough, with the fixing member fitted and engaged in the positioning sleeve and connected with the coupling section of the outlet unit to guide rotation of the outlet unit and to limit removal of the coupling section of the outlet unit from the body; and a guiding seat fixed in the chamber of the body and located below the positioning sleeve, wherein the guiding seat includes two protrusions arranged on an upper end thereof and includes plural joining faces arranged a peripheral side of the guiding seat, wherein each of the plural joining faces has a plurality of flowing pores formed thereon, wherein the two protrusions of the guiding seat retain with the two retaining recesses of the positioning sleeve, and wherein the plural joining faces automatically align with the flowing room of the valve holder of the body.

2. The vertical faucet structure as claimed in claim 1, wherein the outlet unit is an outlet pipe and includes the coupling section formed on a lower end thereof, and wherein the coupling section has a closing ring fitted on an outer wall thereof and has inner threads formed on an inner wall thereof.

3. The vertical faucet structure as claimed in claim 1, wherein the outlet unit includes an outflow mount, an outflow hose, and an outflow connector, wherein the outflow mount is hollow and has the coupling section formed on a lower end thereof, wherein a first end of the outflow hose connects with the outflow connector, and wherein the outflow connector is inserted into the outflow mount.

4. The vertical faucet structure as claimed in claim 2, wherein the positioning sleeve further includes a limiting hole defined therein below the connecting hole, wherein a diameter of the connecting hole is greater than that of the limiting hole, wherein the fixing member also includes a screwing tube arranged on a top thereof and includes a limitation portion formed below the screwing tube, wherein a diameter of the limitation portion is greater than that of the screwing tube, wherein the screwing tube is screwed with the second inner threads of the coupling section of the outlet unit, and wherein the limitation portion is fitted and engaged in the limiting hole of the positioning sleeve to guide the rotation of the outlet unit and to limit the removal of the coupling section of the outlet unit from the body.

5. The vertical faucet structure as claimed in claim 1, wherein the fixing member further includes a circular affix section formed on a bottom thereof and abutting against the top surface of the guiding seat.

6. The vertical faucet structure as claimed in claim 1, wherein the body further includes a valve holder extending outwardly from a peripheral side thereof, wherein the valve holder has a flowing room defined therein and communicating with the chamber, wherein the vertical faucet structure further comprises a control unit which includes a controlling valve, a screwing cap, and a rotating lever, wherein the controlling valve is disposed in the flowing room of the valve holder of the body and is fixed by the screwing cap, wherein the rotating lever is connected with the control valve, and wherein the rotating lever drives the controlling valve to turn on/off and to control water flow.

7. The vertical faucet structure as claimed in claim 1, wherein the body further includes first inner threads formed on a bottom of an inner wall thereof, and wherein the vertical faucet structure further comprises a connecting cover which includes outer threads to screw with the inner threads formed on the bottom of the inner wall of the body, thus fixing the guiding seat in the chamber of the body.

8. The vertical faucet structure as claimed in claim 2, wherein the guiding seat further includes an outlet defined on a top surface thereof and communicating with the outlet unit via the aperture of the fixing member.

9. The vertical faucet structure as claimed in claim 3, wherein the guiding seat further includes a hollow portion defined on a peripheral side thereof to insert the outflow hose into the hollow portion of the guiding seat downwardly.

* * * * *